US011053893B2

(12) United States Patent
Fujiwara

(10) Patent No.: US 11,053,893 B2
(45) Date of Patent: Jul. 6, 2021

(54) COOLING SYSTEM

(71) Applicant: ISUZU MOTORS LIMITED, Tokyo (JP)

(72) Inventor: Yuusuke Fujiwara, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 16/651,769

(22) PCT Filed: Sep. 14, 2018

(86) PCT No.: PCT/JP2018/034197
§ 371 (c)(1),
(2) Date: Mar. 27, 2020

(87) PCT Pub. No.: WO2019/065308
PCT Pub. Date: Apr. 4, 2019

(65) Prior Publication Data

US 2020/0256289 A1 Aug. 13, 2020

(30) Foreign Application Priority Data

Sep. 29, 2017 (JP) ..... JP2017-191161

(51) Int. Cl.
*F01P 9/00* (2006.01)
*F02M 26/05* (2016.01)
(Continued)

(52) U.S. Cl.
CPC ..... *F02M 26/05* (2016.02); *F02M 26/28* (2016.02); *F01P 3/20* (2013.01); *F01P 7/16* (2013.01);
(Continued)

(58) Field of Classification Search
CPC ..... F02M 26/00; F02M 26/05; F02M 26/06; F02M 26/07; F02M 26/24; F02M 26/25; F02M 26/33; F02D 41/0047; F02D 41/005
(Continued)

(56) References Cited

U.S. PATENT DOCUMENTS 10,428,726 B2 * 10/2019 Uto ..... F02M 26/22
2009/0301409 A1 * 12/2009 Dahl ..... F01P 7/167 123/41.1
(Continued)

FOREIGN PATENT DOCUMENTS

CN 102066713 A 5/2011
CN 103184925 A 7/2013
(Continued)

OTHER PUBLICATIONS

Inernational Searc Report and Written Opinion for Related PCT App No. PCT/JP2018/034197 dated Sep. 14, 2018, 11 pgs.
(Continued)

*Primary Examiner* — John Kwon
(74) *Attorney, Agent, or Firm* — Procopio, Cory, Hargreaves & Savitch LLP

(57) ABSTRACT

A cooling system CS according to one aspect of the present invention is provided with: a first cooling circuit C1 which is provided with a first cooling means 54 and in which cooling water can circulate; a second cooling circuit C2 which is provided with a second cooling means 64 and in which cooling water for cooling an engine body 12 can circulate; and an EGR cooler 46 configured to cool an EGR gas. The EGR cooler 46 is provided with: a first EGR cooler 52 installed in the first cooling circuit C1; and a second EGR cooler 62 installed in the second cooling circuit C2. Furthermore, in order to suppress the generation of condensed
(Continued)

water due to condensation of moisture in an exhaust gas during the cooling of the EGR cooler 46, the cooling system CS is provided with a valve 80 configured to control the amount of the cooling water that flows from the second cooling circuit C2 to the first cooling circuit C1.

6 Claims, 2 Drawing Sheets

(51) Int. Cl.

| | |
|---|---|
| ***F02M 26/28*** | (2016.01) |
| *F02M 26/24* | (2016.01) |
| *F02M 26/33* | (2016.01) |
| *F01P 3/20* | (2006.01) |
| *F01P 7/16* | (2006.01) |
| *F01P 5/10* | (2006.01) |
| *F01P 7/14* | (2006.01) |

(52) U.S. Cl.
CPC ... *F01P 2005/105* (2013.01); *F01P 2007/146* (2013.01); *F01P 2060/16* (2013.01); *F02M 26/24* (2016.02); *F02M 26/33* (2016.02)

(58) Field of Classification Search
USPC ..... 123/41.01, 14.05, 41.08, 568.11, 568.12, 123/568.22, 568.31
See application file for complete search history.

(56) References Cited

U.S. PATENT DOCUMENTS

| | | | | |
|---|---|---|---|---|
| 2011/0139131 | A1 | 6/2011 | Kardos et al. | |
| 2011/0162596 | A1 | 7/2011 | Kardos et al. | |
| 2013/0167784 | A1 | 7/2013 | Quix et al. | |
| 2015/0273976 | A1* | 10/2015 | Enomoto | B60L 3/0061 165/202 |
| 2016/0319732 | A1 | 11/2016 | Iwata | |
| 2018/0087451 | A1* | 3/2018 | Bidner | B60H 1/3208 |

FOREIGN PATENT DOCUMENTS

| | | | |
|---|---|---|---|
| CN | 105849386 | A | 8/2016 |
| EP | 1926905 | B1 | 4/2017 |
| JP | 2011523691 | A | 8/2011 |
| JP | 2012503740 | A | 2/2012 |
| JP | 2013514489 | A | 4/2013 |
| JP | 2016050545 | A | 4/2016 |
| WO | 2009151379 | A1 | 12/2009 |
| WO | 2011073512 | A1 | 6/2011 |

OTHER PUBLICATIONS

First Office Action for related CN App No. 201880062503.8 dated Apr. 29, 2021, 15 pgs.

* cited by examiner

[FIG. 1]
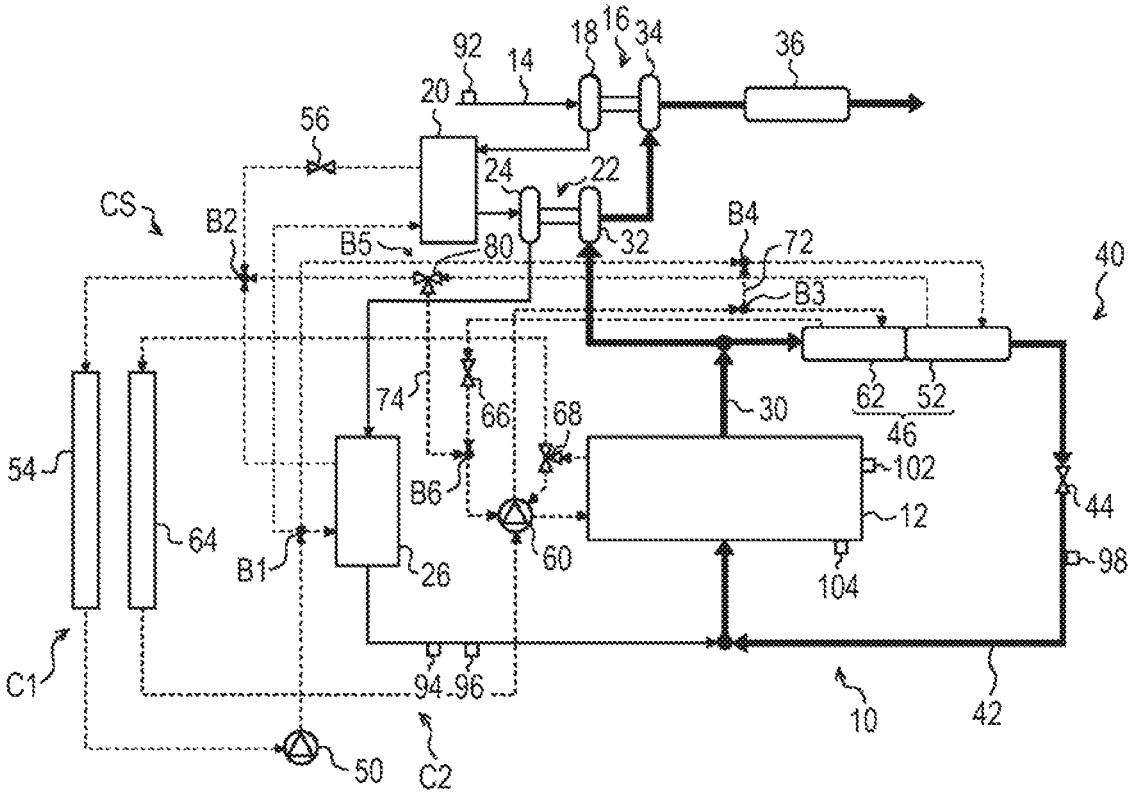
[FIG. 2]
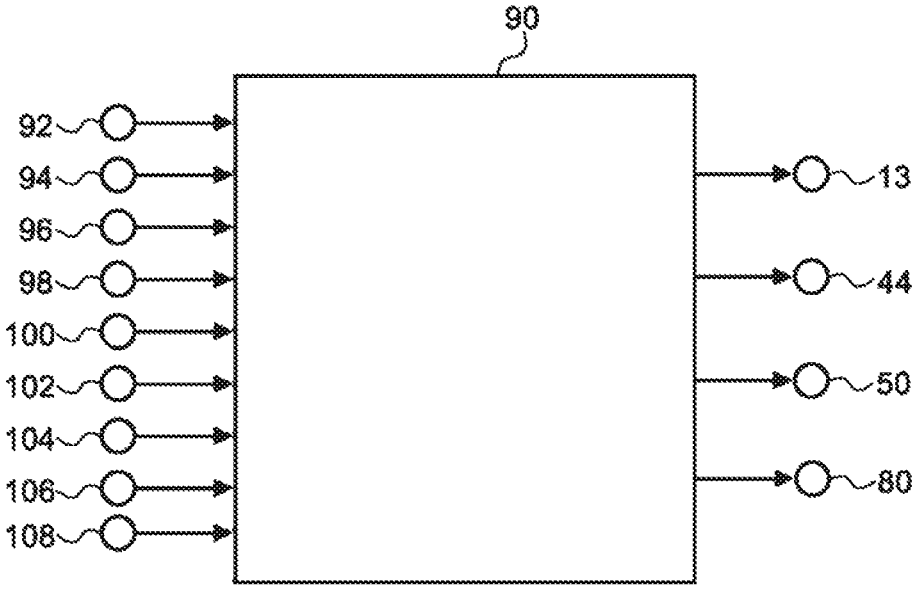

[FIG. 3]
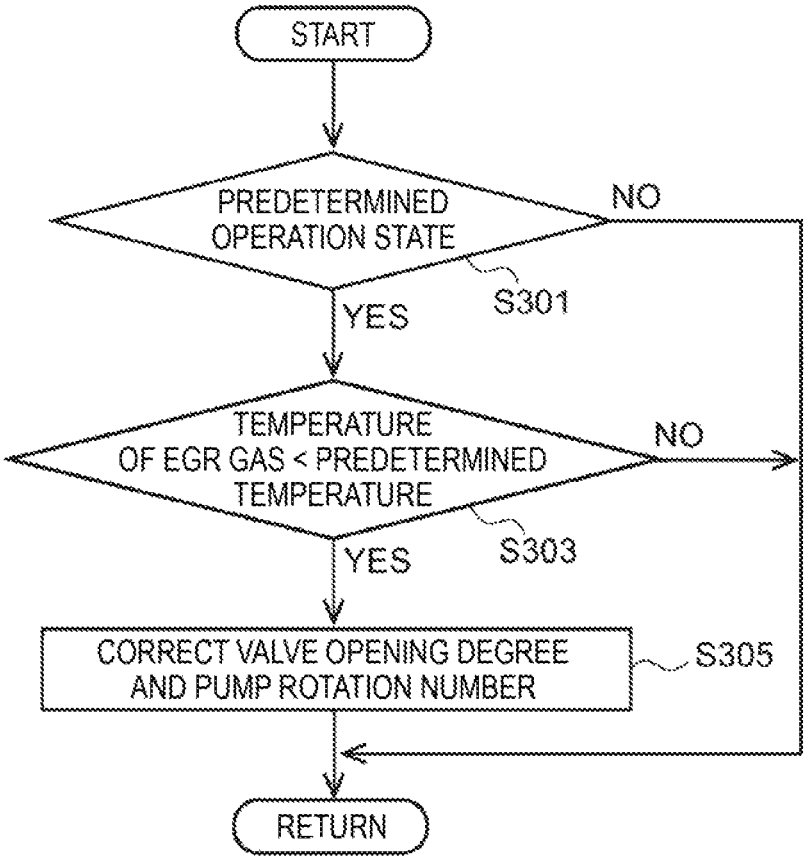
[FIG. 4]
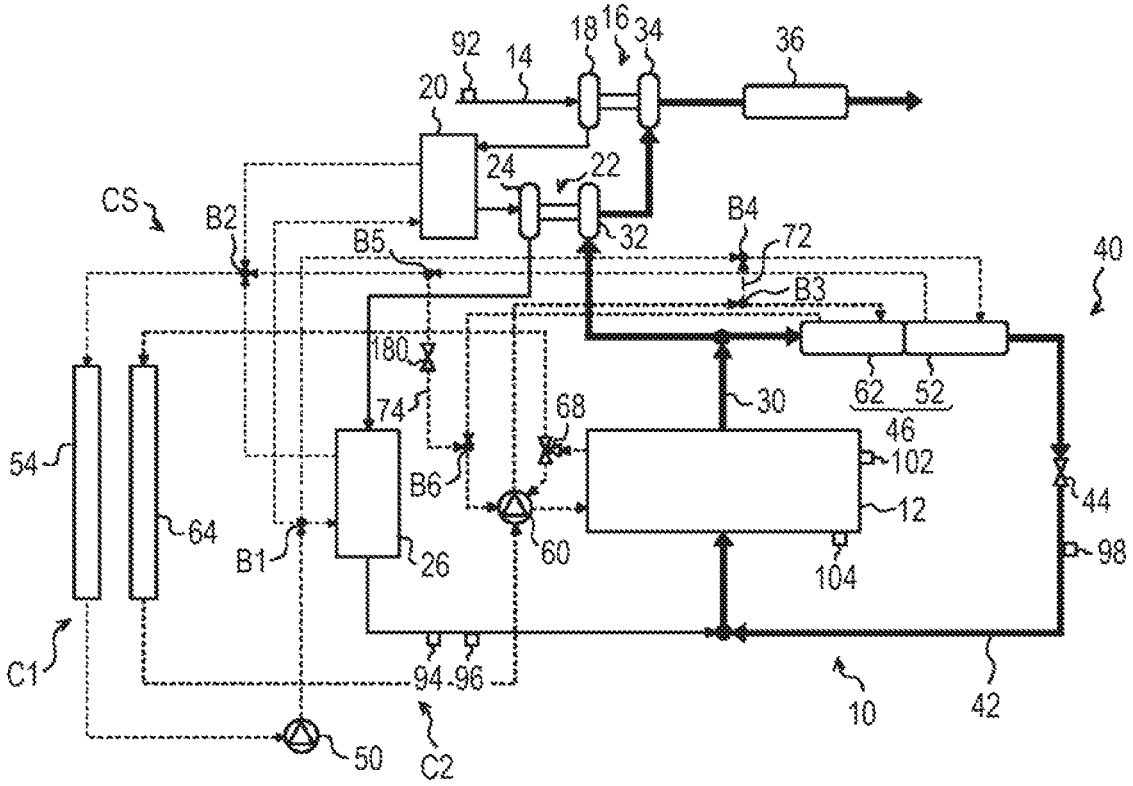

COOLING SYSTEM

CROSS-REFERENCE TO RELATED APPLICATIONS

This application is a U.S. National Stage entry of PCT Application No: PCT/JP2018/034197 filed on Sep. 14, 2018, which claims priority to Japanese Patent Application No. 2017-191161, filed Sep. 29, 2017, the contents of which are incorporated herein by reference.

TECHNICAL FIELD

The technology of the present disclosure relates to a cooling system, and more particularly, to a cooling system having a configuration of cooling an EGR gas by a two-stage cooling method.

BACKGROUND ART

An exhaust gas recirculation (EGR) system, which is a system configured to recirculate a part of an exhaust gas of an engine toward an intake air and to mix the same with a newly sucked air, is known and is actually installed in engines of diverse vehicles.

In the EGR system, in order to cool the exhaust gas to be recirculated (hereinbelow, the EGR gas), an EGR cooler is used. For example, a two-stage cooling method, in which cooling waters of two systems (specifically, cooling waters having different temperatures) are used to cool the EGR gas (refer to PTL 1, for example), is suggested in order to improve fuel efficiency by increasing a cooling capacity of the EGR cooler for the EGR gas.

CITATION LIST

Patent Literature

PTL 1: JP-A-2016-50545

SUMMARY OF INVENTION

Technical Problem

According to the two-stage cooling method as described above, it is possible to further efficiently cool the EGR gas. However, when the EGR gas is excessively cooled, condensed water is generated due to condensation of moisture in the EGR gas. When nitrogen oxides are contained in the EGR gas, for example, the nitrogen oxides are dissolved in the condensed water to form an acid, which may shorten lifetime of a pipe of an intake system.

The technology of the present disclosure is to suppress generation of condensed water due to condensation of moisture in an EGR gas while efficiently cooling the EGR gas.

Solution to Problem

In order to achieve the above object, the technology of the present disclosure provides a cooling system comprising: a first cooling circuit having first cooling means through which a cooling medium can circulate; a second cooling circuit having second cooling means through which the cooling medium for cooling an engine body can circulate; an exhaust cooling device configured to cool an exhaust gas that is to be recirculated from an exhaust system to an intake system of an engine, the exhaust cooling device comprising: a first exhaust cooling unit installed in the first cooling circuit; and a second exhaust cooling unit installed in the second cooling circuit; and a valve configured to regulate an inflow amount of the cooling medium from the second cooling circuit into the first cooling circuit to suppress generation of condensed water due to condensation of moisture in the exhaust gas during cooling of the exhaust cooling device.

Preferably, the cooling system further comprising a first communication path configured to allow a part of the cooling medium flowing in the second cooling circuit to join the cooling medium to flow into the first exhaust cooling unit of the exhaust cooling device. The valve may be provided to the first communication path.

Preferably, the cooling system further comprising a second communication path configured to allow a part of the cooling medium having passed through the first exhaust cooling unit of the exhaust cooling device to flow toward the second cooling circuit. The valve may be provided to the second communication path.

Preferably, the cooling system further comprising a valve control means configured to control drive of the valve, wherein the valve control means is configured to control the valve, based on a temperature of the exhaust gas having passed through the exhaust cooling device.

Preferably, the cooling system further comprising: a first pump provided to pneumatically transport the cooling medium to the first cooling circuit; and pump control means configured to control an actuation of the first pump, wherein the pump control means is configured to control the actuation of the first pump, based on a temperature of the exhaust gas having passed through the exhaust cooling device.

Advantageous Effect of Invention

According to the technology of the present disclosure, it is possible to suppress generation of condensed water due to condensation of moisture in the EGR gas while efficiently cooling the EGR gas.

BRIEF DESCRIPTION OF DRAWINGS

FIG. 1 is a schematic configuration view of an internal combustion engine system of a vehicle to which a cooling system in accordance with a first embodiment is applied.

FIG. 2 is a control configuration view of the internal combustion engine system shown in FIG. 1.

FIG. 3 is a control flowchart of the first embodiment.

FIG. 4 is a schematic configuration view of an internal combustion engine system of a vehicle to which a cooling system in accordance with a second embodiment is applied.

DESCRIPTION OF EMBODIMENTS

Hereinbelow, embodiments will be described with reference to the drawings. First, a first embodiment is described.

A schematic view of an internal combustion engine system of a vehicle to which a cooling system CS in accordance with the first embodiment is applied is shown in FIG. 1. In the first embodiment, an internal combustion engine (hereinbelow, referred to as 'engine') 10 is an engine configured to spontaneously ignite diesel fuel by directly injecting the same from an injector to a combustion chamber in a compressed state, i.e., a Diesel engine. However, the engine to which the present disclosure is applied is not limited thereto. That is, the present disclosure can also be applied to a variety of types of other engines.

The engine 10 is a so-called multi-cylinder engine having a plurality of cylinders provided to an engine body 12. However, a single cylinder engine is also possible. In an intake system of the engine 10, an air (herein, a new air) sucked into an intake passage 14 through an air cleaner (not shown) sequentially passes through a compressor 18 of a first turbo charger 16, a first intercooler (a first intake cooling device) 20, a compressor 24 of a second turbo charger 22, a second intercooler (a second intake cooling device) 26, an intake manifold, an intake port, and an intake valve, and is then sucked into a combustion chamber of each cylinder of the engine body 12. Fuel injected from an injector 13 (not shown in FIG. 1) is combusted in the combustion chamber, and an exhaust gas generated as a result of the combustion is discharged from the combustion chamber to an exhaust passage 30 through an exhaust valve (not shown). In an exhaust system of the engine 10, the exhaust gas sequentially passes through an exhaust valve, an exhaust port, an exhaust manifold, a turbine 32 of the second turbo charger 22, a turbine 34 of the first turbo charger 16 and an exhaust purification device 36 and is then discharged. Like this, the engine 10 has the two turbo chargers, and the vehicle to which the engine 10 is mounted is a two-stage turbo-mounted vehicle.

The engine 10 is provided with an exhaust gas recirculation system (EGR system) 40 configured to guide a part of the exhaust gas flowing in the exhaust passage 30 (exhaust system) to the intake passage 14 (intake system). The EGR system 40 includes a passage (EGR passage) 42 configured to couple the exhaust passage 30 and the intake passage 14 each other, an EGR valve 44 for regulating a communication state of the EGR passage 42, and an EGR cooler (exhaust cooling device) 46 for cooling an exhaust gas (EGR gas) to be recirculated. The EGR valve 44 is configured as an electromagnetic valve of which actuations are controlled by an electronic control unit (hereinbelow, referred to as 'ECU') that will be described later. Also, the EGR valve 44 is arranged on a downstream side of the EGR cooler 46, i.e., on the intake system-side. However, the present disclosure is not limited thereto. Herein, one end of the EGR passage 42 on an upstream side is connected to the exhaust manifold, and the other end on a downstream side thereof is connected to the intake manifold. However, the connection positions are not limited thereto. Also, as described later, the EGR cooler 46 is configured by two EGR coolers 52 and 62, but each of which is a heat exchanger configured to cool the EGR gas by causing heat exchange between the cooling water and the exhaust gas (EGR gas).

The cooling system CS applied to the engine 10 is described.

As shown in FIG. 1, the cooling system CS includes a first cooling circuit C1, and a second cooling circuit C2. In the cooling system CS, cooling water having the same component as so-called engine cooling water circulates as a cooling medium. However, the type of the cooling medium is not limited thereto. First, the first cooling circuit C1 is described.

The first cooling circuit C1 is configured to communicate with the second cooling circuit C2 through a communication path that will be described later, but except this, forms a closed circuit in which the cooling water circulates. The first cooling circuit C1 is provided with a first pump 50, a first EGR cooler (first exhaust cooling unit) 52 included in the EGR cooler 46, and a first heat exchanger (first cooling means) 54. In addition, the first cooling circuit C1 is provided with a first intercooler 20, and a second intercooler 26. The first cooling circuit C1 includes a flow path for cooling water in the first EGR cooler but mainly includes a flow path for cooling water in the intercoolers (intake cooling devices) 20 and 26 so as to cool the air sucked into the intake passage 14, particularly, the air compressed with the compressors 18 and 24 of the turbo chargers. The first pump 50 is configured as an electric pump that is driven with power of a battery (not shown). As described later, a pump rotation number of the first pump 50 is controlled. By controlling the first pump, a circulation degree of the cooling water in the first cooling circuit C1 can be regulated. Therefore, it is possible to change a cooling capacity in each device or means (for example, the first EGR cooler 52) of the first cooling circuit C1. In the meantime, the intercoolers 20 and 26 are respectively a heat exchanger configured to cause heat exchange between the cooling water and an intake air. The first heat exchanger 54 is a so-called radiator, and is configured to cool the cooling water by causing heat exchange between the cooling water and an outside air. Like this, the closed circuit of the first cooling circuit C1 does not include a flow path for cooling water formed in the engine body 12.

The cooling water pneumatically transported by the first pump 50 is split into a cooling path to the first intercooler 20, a cooling path to the second intercooler 26 and a cooling path to the first EGR cooler 52 at a branch part B1. A distribution ratio of the cooling water into the intercoolers 20 and 26 and the first EGR cooler is herein decided by a configuration of the flow path and a configuration of a first throttle valve 56, and is set to a predetermined distribution ratio. Herein, the first throttle valve 56 is configured as a valve for regulating a flow rate but may also be configured as an electromagnetic valve that is configured by an ECU, which will be described later. The first throttle valve 56 is provided between an outlet of the first intercooler 20 and a confluence part B2 but may be provided at another place. Also, the first throttle valve 56 may be configured as an orifice, may be omitted by adjusting a pipe configuration or may be omitted by using one or more other valves. The cooling waters having passed through the first intercooler 20, the second intercooler 26 and the first EGR cooler 52 join at the confluence part B2, which in turn flows into the first heat exchanger 54 and is cooled in the first heat exchanger 54. The cooling water having passed through the first heat exchanger 54 again reaches the first pump 50 and again circulates in the first cooling circuit C1.

The second cooling circuit C2 is configured to communicate with the first cooling circuit C1 through a communication path that will be described later, but except this, forms a closed circuit in which the cooling water circulates. The second cooling circuit C2 is provided with a second pump 60, a second EGR cooler (second exhaust cooling unit) 62 included in the EGR cooler 46, and a second heat exchanger (second cooling means) 64. However, the second EGR cooler 62 is provided upstream of the first EGR cooler 52. In this way, the cooling system CS adopts, as a cooling configuration for the EGR gas, a two-stage cooling method of cooling by the second EGR cooler installed (having a cooling path) in the second cooling circuit C2 and next cooling by the first EGR cooler installed (having a cooling path) in the first cooling circuit C1. In the meantime, the second beat exchanger 64 is a so-called radiator, and is configured to cool the cooling water by causing heat exchange between the cooling water and the outside air. In addition, the second cooling circuit C2 includes a flow path for cooling water formed in the engine body 12. The second cooling circuit C2 includes a flow path for cooling water in the second EGR cooler but is configured so that the cooling water for cooling the engine body 12 can circulate therein. Therefore, in general, since the cooling water flowing in the second cooling circuit C2 has a higher temperature than the cooling water flowing in the first cooling circuit C1, the first cooling circuit C1 may be referred to as a low-temperature cooling circuit, and the second cooling circuit C2 may be referred to as a high-temperature cooling circuit. In this case, the first heat exchanger 54 of the first cooling circuit C1 may be referred to as a low-temperature heat exchanger (LT Radiator), and the second heat exchanger 64 of the second cooling circuit C2 may be referred to as a high-temperature heat exchanger (HT Radiator).

The cooling water pneumatically transported by the second pump 60 is split into a cooling path to the engine body 12 and a cooling path to the second EGR cooler 62. In this case, a distribution ratio is decided by a configuration of the flow path and a configuration of a second throttle valve 66, and is set to a predetermined distribution ratio. Herein, the second throttle valve 66 is configured as a valve for regulating a flow rate but may be configured as an electromagnetic valve that is configured by an ECU, which will be described later. The second throttle valve 66 is arranged so that the cooling water having passed through the second EGR cooler 62 is to return to the second pump 60 through the second throttle valve 66. In the meantime, the second throttle valve 66 may be provided at another place, may be configured as an orifice, may be omitted by adjusting a pipe configuration or may be omitted by using one or more other valves. Also, a thermostat valve 68 is configured and arranged so that the cooling water having passed through the engine body 12 is to flow toward any one or both of the second pump 60 and the second heat exchanger 64 through the thermostat valve 68. Upon warming up of the engine, for example, since the temperature of the cooling water is low, the thermostat valve 68 is positioned in a closed state (or opened state) so that all of the cooling water flows toward the second pump 60. After the warming up of the engine, for example, when the temperature of the cooling water becomes equal to or higher than a predetermined temperature, the thermostat valve 68 is opened (or closed) at a predetermined degree of opening so that a part or all of the cooling water flows to the second heat exchanger 64. The cooling water cooled in the second heat exchanger 64 again reaches the second pump 60, and again circulates in the second cooling circuit C2. In this way, in the second cooling circuit C2, the cooling water that cools (have cooled) the engine body 12 can circulate in the second heat exchanger 64.

The first cooling circuit C1 and the second cooling circuit C2 are coupled to each other by two communication paths 72 and 74. The first communication path 72 that is one of the two communication paths is formed to interconnect a flow path part of the first cooling circuit C1 through which the cooling water flows from the first pump 50 to the first EGR cooler 52, and a flow path part of the second cooling circuit C2 through which the cooling water flows A from the second pump 60 to the second EGR cooler 62. As shown in FIG. 1, the first communication path 72 interconnects a branch part B3 of the second cooling circuit C2 and a confluence part B4 of the first cooling circuit C1. That is, in the first communication path 72, the cooling water flows from the second cooling circuit C2-side toward the first cooling circuit C1 due to a difference between sizes of the first cooling circuit C1 and the second cooling to circuit C2, a difference between discharge capacities of the pumps 50 and 60, a difference between the flow path configurations of both the circuits C1 and C2, and the like. Through the first communication path 72, a part of the cooling water flowing in the second cooling circuit C2 can join the cooling water to flow into the first EGR cooler 52 of the first cooling circuit C1. Thereby, a part of the cooling water cooled via the second heat exchanger 64 (before flowing into the second EGR cooler 62) joins the cooling water cooled via the first heat exchanger 54 (before flowing into the first EGR cooler 52). Therefore, even though the cooling water flows from the second cooling circuit C2-side toward the first cooling circuit C1, the cooling water flowing through a cooling water path (flow path) in the first EGR cooler 52 is at a relatively low temperature.

The second communication path 74 that is the other of the two communication paths is formed to interconnect a flow path part of the first cooling circuit C1 through which the cooling water flowing out from the first EGR cooler 52 flows toward the first heat exchanger 54, and a flow path part of the second cooling circuit C2 through which the cooling water flowing out from the second EGR cooler 62 flows toward the second pump 60. As shown in FIG. 1, the second communication path 74 interconnects a branch part B5 of the first cooling circuit C1 and a confluence part B6 of the second cooling circuit C2. That is, in the second communication path 74, the cooling water flows from the first cooling circuit C1-side toward the second cooling circuit C2 due to a difference between sizes of the first cooling circuit C1 and the second cooling circuit C2, a difference between discharge capacities of the pumps 50 and 60, a difference between the flow path configurations of both the circuits C1 and C2, and the like, differently from the first communication path 72. Through the second communication path 74, a part of the cooling water having passed through the first EGR cooler 52 of the first cooling circuit C1 can join the cooling water flowing in the second cooling circuit C2.

Also, a control valve 80 is provided so as to further securely control the flow of the cooling water between the first cooling circuit C1 and the second cooling circuit C2 (particularly, an inflow amount of the cooling water from the second cooling circuit C2 into the first cooling circuit C1). The control valve 80 is provided to the second communication path 74. More specifically, the control valve 80 configured as a three-way valve is provided at the branch part B5 on an upstream side of the second communication path 74. The control valve 80 is provided to split the cooling water flowing out from a cooling water outlet of the first EGR cooler 52 into an inlet-side of the second pump 60 and an inlet-side of the first heat exchanger 54, and is also configured to cause an entire amount of the cooling water to flow toward only one of the second pump 60 and the first heat exchanger 54. By regulating an opening degree of the control valve 80, it is possible to regulate an amount of the cooling water (an amount of return) from the first cooling circuit C1 into the second cooling circuit C2 through the second communication path 74, so that it is possible to regulate an amount of the cooling water (an amount of confluence) from the second cooling circuit C2 into the first cooling circuit C1 through the first communication path 72. This is because there is a correlation between the amount of return and the amount of confluence of the cooling water. In this way, by regulating an opening degree of the control valve 80, it is possible to regulate an amount of confluence of the cooling water (relatively high temperature) in the second cooling circuit C2 to the cooling water (relatively low temperature) in the first cooling circuit C1 through the first communication path 72, so that it is possible to regulate the temperature of the cooling water to be supplied to the first EGR cooler 52, i.e., the cooling capacity of the first EGR cooler 52.

An ECU 90 configured to control actuations of the injector 13, the EGR valve 44, the control valve 80 and the like is connected to a variety of sensors configured to electrically output signals for obtaining (detecting or estimating) diverse values. Herein, some of the sensors are specifically described. As shown in FIG. 2, the intake passage 14 is provided with an airflow meter 92 for detecting an intake air amount. Also, the intake passage 14 is provided with an intake temperature sensor 94 for detecting a temperature of intake air and a pressure sensor 96 for detecting a supercharging pressure. Also, a part of the EGR passage on a downstream side of the EGR cooler 46 is provided with a temperature sensor (hereinbelow, an EGR temperature sensor) 98 for detecting a temperature of the exhaust gas having passed through the EGR cooler 46, particularly the first EGR cooler 52 on a downstream side (of the second EGR cooler 62), i.e., a temperature of the EGR gas. Also, an accelerator opening degree sensor 100 for detecting a position corresponding to a stepping amount on an accelerator pedal that is operated by a driver, i.e., an accelerator opening degree. Also, a cylinder block in which a piston is configured to reciprocate in each cylinder is attached with a crank position sensor 102 for detecting a crank rotation signal of a crankshaft to which the piston is coupled via a connecting rod. Herein, the crank position sensor 102 is also used as an engine rotating speed sensor for detecting an engine rotating speed. Also, a cooling water temperature sensor 104 for detecting a cooling water temperature in the engine 10 is provided. Also, a vehicle speed sensor 106 for detecting a vehicle speed is provided. Also, an outside temperature sensor 108 for detecting an outside temperature is provided.

The ECU 90 is configured as a so-called computer including a calculation device (for example, a CPU), a storage device (for example, a ROM and a RAM), an A/D converter, an input interface, an output interface, and the like. The input interface is electrically connected to the above-described diverse sensors. Based on output signals from the diverse sensors, the ECU 90 outputs electrically a variety of actuation signals (drive signals) from the output interface so that the engine 10 is smoothly operated and actuated in accordance with a preset program and the like. In this way, an actuation of the injector 13, an opening degree of the EGR valve 44, an opening degree of the control valve 80, and the like are controlled. Also, herein, an actuation (for example, a pump rotation number) of the first pump 50 that is an electric pump is controlled by the ECU 90. In the meantime, herein, the second pump 60 is a pump that is driven by power of the engine 10 but may also be configured as an electric pump that is controlled by the ECU 90. Therefore, the ECU 90 functions as a control means of each of the injector 13, the EGR valve 44, the first pump 50, and the control valve 80.

Herein, the ECU 90 is configured to control an opening degree of the EGR valve 44, based on an engine operation state that is decided on the basis of an engine load (for example, an intake air amount) and an engine rotating speed detected (acquired) based on the outputs of the diverse sensors. In the meantime, the engine load is not limited to the configuration in which it is decided only by an intake air amount, and may also be decided using one or any combination of an intake air amount, an opening degree of the accelerator and an intake air pressure, for example. Herein, data decided in advance by tests, which is established so that an EGR ratio (a ratio of an EGR gas to an intake air to be sucked into a combustion chamber) decreases as a region to which the engine operation state belongs is on a higher load side, is stored in the storage device. In the meantime, the data is just exemplary, and a variety of data established in accordance with performance, characteristic and the like of the engine 10 may be used for control on the EGR valve.

Subsequently, the control on the first pump 50 and the control valve 80 is described, based on a flowchart of FIG. 3. In the meantime, the routine shown in FIG. 3 is repeatedly executed with predetermined time intervals.

First, in step S301, the ECU 90 determines whether the engine operation state decided as described above is a predetermined operation state. The predetermined operation state is an operation state of recirculating the EGR gas from the exhaust system to the intake system by opening the EGR valve 44. That is, when the EGR gas is in the operation state in which it is recirculated to the intake system, a result of the determination in step S301 is affirmative. On the other hand, when the EGR valve 44 is completely closed and the EGR gas is thus in an operation state in which it is not recirculated to the intake system, a result of the determination in step S301 is negative and the routine is over.

When the operation state is determined affirmative in step S301, the ECU 90 opens the EGR valve 44 based on the data decided in advance on the basis of tests and the like and the program, and also controls the actuation (specifically, the pump rotation number) of the first pump 50 and the opening degree the control valve 80, based on the data decided in advance on the basis of tests and the like and the program. Herein, at this time, the pump rotation number (a basic pump rotation number) of the first pump 50 and the opening degree (a basic opening degree) of the control valve 80 are set so that a desired fuel efficiency is achieved by efficiently cooling the intake air with the first and second intercooler 20 and 26 and efficiently cooling the exhaust gas being recirculated, i.e., the EGR gas. However, the pump rotation number of the first pump 50 and the opening degree of the control valve 80 are set more preferably after comprehensively considering an exhaust purification effect in the exhaust purification device 36, an amount of soot generated due to combustion of fuel in the combustion chamber, and the like.

When a result of the determination in step S301 is affirmative, it is determined in step S303 whether the temperature of the EGR gas is below a predetermined temperature. Herein, the predetermined temperature is a temperature equal to or higher than a temperature (hereinbelow, referred to as 'condensed water generation temperature') at which condensed water is likely to be generated due to condensation of moisture in the EGR gas, and is decided and stored in advance based on tests and the like. The condensed water generation temperature may be defined as meaning that when a temperature of the EGR gas is lower than the condensed water generation temperature, a possibility of condensed water generation is equal to or higher than a predetermined level. The predetermined temperature in step S303 may be the condensed water generation temperature but is herein a temperature higher than the same by a predetermined margin (for example, 5° C.). Also, the predetermined temperature is not limited to the preset temperature, and may be calculated and set in real time by a predetermined calculation, based on the outputs from the diverse sensors. Based on an output of the EGR temperature sensor 98, the ECU 90 detects (acquires) a temperature of the EGR gas. When the acquired temperature of the EGR gas is below the predetermined temperature, a result of the determination in step S303 is affirmative. On the other hand, when the acquired temperature of the EGR gas is equal to or higher than the predetermined temperature, a result of the determination in step S303 is negative and the routine is over. In the meantime, the basic pump rotation number of the first pump 50 and the basic opening degree of the control valve 80 are basically set so that the acquired temperature of the EGR gas is not below the predetermined temperature in step S303 or the condensed water generation temperature but are mainly set so that the fuel efficiency is improved by the intake air cooling (including cooling of the EGR gas) as described above.

When a result of the determination in step S303 is affirmative because the temperature of the EGR gas is below the predetermined temperature, a control of correcting the basic pump rotation number of the first pump 50 and the basic opening degree of the control valve 80 is executed in step S305. This correction control is a control based on the acquired temperature of the EGR gas, and is a control for increasing the temperature of the EGR gas to the predetermined temperature or higher. More specifically, the correction control is a feedback control based on the temperature of the EGR gas. A correction coefficient is calculated in accordance with data and the like preset on the basis of the acquired temperature of the EGR gas, and the correction coefficient is applied to the basic pump rotation number and the basic opening degree. Thereby, the opening degree (a control target value) of the control valve 80 is corrected so that as the acquired temperature of the EGR gas is lower with respect to the predetermined temperature, the temperature of the cooling water to be sent to the first EGR cooler 52 becomes higher, i.e., an amount of the cooling water that joins the first cooling circuit C1-side from the second cooling circuit C2-side through the first communication path 72 is increased. Also, the pump rotation number (a control target value) of the first pump 50 is corrected so that as the acquired temperature of the EGR gas is lower with respect to the predetermined temperature, the cooling capacity in the first EGR cooler 52 is lowered, specifically, the circulation of the cooling water in the first cooling circuit C1 is suppressed. Then, based on the corrected values, the ECU 90 (each of a functional unit of the ECU corresponding to the pump control means and a functional unit of the valve control means) controls the actuation of the first pump 50 and the opening degree of the control valve 80. In the meantime, the routine is over after the processing is executed via step S305.

As described above, according to the cooling system CS of the first embodiment, the first pump 50 and the control valve 80 are subjected to the correction control on the basis of the acquired temperature of the EGR gas so that the acquired temperature is equal to or higher than the predetermined temperature. Therefore, while effectively cooling the EGR gas by the EGR cooler of the two-stage cooling method, it is possible to more appropriately suppress the generation of condensed water due to the EGR gas.

In the meantime, in the first embodiment, when a result of the determination in step S303 is affirmative because that the temperature of the EGR gas is below the predetermined temperature, both the pump rotation number of the first pump 50 and the opening degree of the control valve 80 are corrected in step S305. However, only one, for example, only the opening degree of the control valve 80 may be subjected to the correction control. Also, after the correction control on the opening degree of the control valve 80 is preferentially performed and the correction on the control valve is then performed up to a predetermined level, the correction control on the first pump may be performed. The reverse is also possible.

Also, when performing the correction control on at least one of the pump rotation number of the first pump 50 and the opening degree of the control valve 80, at least one of the vehicle speed detected (acquired) based on the output of the vehicle speed sensor 106 and the outside temperature (acquired) based on the output of the outside temperature sensor 108 is preferably considered. The reason is that the higher the vehicle speed is or the lower the outside temperature is, the higher the cooling performance in the first heat exchanger 54 of the first cooling circuit C1 is, and the more the cooling water and eventually the EGR gas are cooled. Furthermore, when performing the correction control on at least one of the pump rotation number of the first pump 50 and the opening degree of the control valve 80, the temperature of the cooling water in the first cooling circuit C and the temperature of the cooling water in the second cooling circuit C2 are more preferably considered. Thereby, it is possible to control the pump rotation number of the first pump 50 and the opening degree of the control valve 80, more favorably. In the meantime, in this case, a temperature sensor for detecting the temperature of the cooling water in the first cooling circuit C1 and a temperature sensor for detecting the temperature of the cooling water in the second cooling circuit C2 are provided.

Also, in the control of the first embodiment, when changing the discharge amount of the first pump, the pump rotation number of the first pump is changed. However, when the first pump is configured to vary the discharge amount thereof by a variety of mechanisms (for example, a variable blade mechanism and a variable swash plate angle mechanism), it is possible to perform control in conformity to the mechanisms.

Subsequently, a second embodiment is described with reference to FIG. 4. The second embodiment is different from the first embodiment, particularly in terms of the installation place of the control valve. Therefore, in the below, the difference is mainly described, and the constitutional elements equivalent to the constitutional elements described already are denoted with the same reference signs in descriptions below and FIG. 4 and the overlapping descriptions are omitted.

In the cooling system CS of the second embodiment, a control valve 180 is provided on the way of the second communication path 74 so as to regulate an amount of confluence of the cooling water from the second cooling circuit C2 to the first cooling circuit C1. The control valve 180 is configured as a two-way valve. Therefore, in the cooling system of the second embodiment, the cooling water having passed through the first EGR cooler 52 reaches the first heat exchanger 54 without stop and is cooled in the first heat exchanger 54. When the EGR valve 44 is in a completely closed state, the control valve 180 is controlled to the closed state, and when the EGR valve 44 is in the opened state, the control valve 180 is controlled to an opening degree set on the basis of data and the like decided in advance based on tests and the like so that a predetermined amount of cooling water set in accordance with the engine operation state joins from the second cooling circuit C2-side to the first cooling circuit C1-side through the first communication path 72. Since the correction control on the control valve 180 is substantially the same as that described on the basis of FIG. 3 of the first embodiment, the additional descriptions are herein omitted.

Therefore, like the first embodiment, also in the second embodiment, the temperature of the cooling water in the first EGR cooler 52 is regulated based on the temperature of the EGR gas, so that the temperature of the EGR gas can be maintained at the predetermined temperature (or the condensed water generation temperature) or higher. Thereby, the generation of condensed water can be favorably suppressed.

In the second embodiment, the first throttle valve 56 and the second throttle valve 66 described in the first embodiment are not provided. However, a variety of valves (for example, a throttle valve) may be provided so as to regulate a flow rate of the cooling water at each place of each of the circuits C1 and C2.

Although the two embodiments of the present disclosure have been described, diverse changes can be made. For example, the installation place of the control valve for controlling the flow of the cooling water between the first cooling circuit and the second cooling circuit is not limited to the above-described place. For example, the control valve may be provided on the first communication path. Also, the number of the control valves may be two or more. For example, the control valve may be provided for each of the first communication path and the second communication path.

Also, in the above embodiments, the control valve is provided so as to control the flow of the cooling water between the first cooling circuit and the second cooling circuit. However, a valve except the control valve, for example, a thermostat valve may also be provided so as to regulate an amount of confluence of the cooling water from the second cooling circuit to the first cooling circuit. In this case, a relation between the temperature of the EGR gas and the temperature of the cooling water flowing out from the EGR cooler (for example, the first EGR cooler) may be obtained by a test, and the thermostat valve may be configured based on the relation. Also in this case, an opening degree of the thermostat valve is spontaneously regulated substantially based on the temperature of the EGR gas flowing out from the EGR cooler, so that the amount of confluence of the cooling water from the second cooling circuit to the first cooling circuit can be regulated.

Also, in the above embodiments, the cooling system of the present disclosure is applied to the engine having the two turbo chargers. However, the present disclosure can also be applied to an engine having only one turbo charger or an engine without a turbo charger. Furthermore, in the above embodiments, the two EGR coolers 52 and 62 are arranged in series in contact with each other but may be completely separated or may be configured as a completely integral EGR cooler.

Also, in the above embodiments, the cooling capacity of the first EGR cooler can be regulated by regulating the amount of confluence from the second cooling circuit to the first cooling circuit. Considering a temperature difference of the cooling water at places in the first cooling circuit, a mechanism and the like for changing a flow of the cooling water in the first cooling circuit may be provided so as to prevent the generation of condensed water, so that the cooling capacity of the first EGR cooler can be further regulated.

Although the representative embodiments of the present invention have been described, the present invention can be diversely changed. A variety of replacements and changes can be made without departing from the spirit and scope of the present invention defined in the claims of the present disclosure.

The subject application is based on Japanese Patent Application No. 2017-191161 filed on Sep. 29, 2017, the contents of which are incorporated herein by reference.

INDUSTRIAL APPLICABILITY

The present invention has effects of favorably suppressing the generation of condensed water due to condensation of moisture in the EGR gas while effectively cooling the EGR gas, and is useful for the cooling system and the like.

REFERENCE SIGNS LIST

10: engine
12: engine body
40: EGR system
46: EGR cooler (exhaust cooling device)
50: first pump
52: first EGR cooler (first exhaust cooling unit)
54: first heat exchanger (first cooling means)
60: second pump
62: second EGR cooler (second exhaust cooling unit)
64: second heat exchanger (second cooling means)
80: control valve
90: electronic control unit (ECU)
CS: cooling system
C1: first cooling circuit
C2: second cooling circuit

The invention claimed is:

1. A cooling system comprising:

a first cooling circuit having a first cooling device through which a cooling medium can circulate;

a second cooling circuit having a second cooling device through which the cooling medium for cooling an engine body can circulate;

an exhaust cooling device configured to cool an exhaust gas that is to be recirculated from an exhaust system to an intake system of an engine, the exhaust cooling device comprising:

a first exhaust cooling device installed in the first cooling circuit; and a second exhaust cooling device installed in the second cooling circuit;

a valve configured to regulate an inflow amount of the cooling medium from the second cooling circuit into the first cooling circuit to suppress generation of condensed water due to condensation of moisture in the exhaust gas during cooling of the exhaust cooling device a first communication path configured to allow a part of the cooling medium flowing in the second cooling circuit to join the cooling medium to flow into the first exhaust cooling device of the exhaust cooling device; and a second communication path configured to allow a part of the cooling medium having passed through the first exhaust cooling device of the exhaust cooling device to flow toward the second cooling circuit.

2. The cooling system according to claim 1, wherein the valve is provided to the first communication path.

3. The cooling system according to claim 1, wherein the valve is provided to the second communication path.

4. The cooling system according to claim 1, further comprising a valve controller configured to control drive of the valve, wherein the valve controller is configured to control the valve, based on a temperature of the exhaust gas having passed through the exhaust cooling device.

5. The cooling system according to claim 1, further comprising:

a first pump provided to pneumatically transport the cooling medium to the first cooling circuit; and a pump controller configured to control an actuation of the first pump, wherein the pump controller is configured to control the actuation of the first pump, based on a temperature of the exhaust gas having passed through the exhaust cooling device.

6. The cooling system according to claim 1, further comprising:

a second pump provided to pneumatically transport the cooling medium to the second cooling circuit, wherein the second pump is connected to the second communication path and configured to receive the cooling medium having passed through the second communication path.

* * * * *